US005267500A

United States Patent [19]

Lombardi

[11] Patent Number: 5,267,500

[45] Date of Patent: Dec. 7, 1993

[54] REMOTE CONTROL OF CYMBALL APPARATUS

[75] Inventor: Donald G. Lombardi, Thousand Oaks, Calif.

[73] Assignee: Drum Workshop, Inc., Oxnard, Calif.

[21] Appl. No.: 964,859

[22] Filed: Oct. 22, 1992

[51] Int. Cl.[5] ..... G10D 13/08

[52] U.S. Cl. ..... 84/402; 84/422.3

[58] Field of Search ..... 84/402, 421, 422.2, 84/422.3, 453

[56] References Cited

U.S. PATENT DOCUMENTS

| | | | |
|---|---|---|---|
| 3,967,523 | 7/1976 | Currier et al. | 84/422 R |
| 4,520,710 | 6/1985 | Elliot, Jr. | 84/422 R |
| 4,747,333 | 5/1988 | Hoshino | 84/422 R |
| 4,889,028 | 12/1989 | Lombardi | 84/421 |
| 5,121,665 | 6/1992 | Meyers et al. | 84/421 |

*Primary Examiner*—Michael L. Gellner
*Assistant Examiner*—P. Stanzione
*Attorney, Agent, or Firm*—William W. Haefliger

[57] ABSTRACT

For use in actuating a cymbal or the like, there being an upright support stand and an upright rod associated with the stand and attached to the cymbal to move it vertically, and there being a foot activated pedal unit remote from the stand comprising a frame associated with the stand, and a connector unit associated with the frame, the rod connected with the connector unit to be moved upwardly and downwardly by the unit; a flexible cable extending between the pedal unit and the connector unit, the cable having opposite ends, one end of the cable operatively connected with the pedal unit and the other end of the cable removably connected with the connector unit, to move the connector unit upwardly and downwardly in response to foot actuation of the pedal unit; and a sheath extending about the cable between the pedal unit and the frame, the cable movable endwise within the sheath; whereby the cable can be disconnected from the connector unit, and removed endwise from the sheath, for cleaning and lubrication thereof.

13 Claims, 2 Drawing Sheets

REMOTE CONTROL OF CYMBALL APPARATUS

BACKGROUND OF THE INVENTION

This invention relates generally to cymbal and/or so-called hi-hat apparatus, and more particularly to remote actuation of such equipment, as via foot actuated pedal units.

There is need for easily usable and maintainable apparatus of the above type. This need becomes acute where a flexible cable is employed between a foot actuated pedal unit and a cymbal or hi-hat actuating rod to be moved up and down by the pedal unit. The cable and its sheath must be kept in lubricated condition to allow easy (low friction) actuation of the cymbal or hi-hat, in response to foot pedal actuation; however, repeated sliding of the cable back and forth in its sheath can produce wear and resultant particle formation and build-up, tending to clog the clearances between the cable and its sheath, and increasing friction between the cable and sheath. Operation of the cymbal or hi-hat then becomes undesirably difficult. Also, simple, effective mounting structure for the cable in relation to its operation of the rod is needed, and allowing ready detachment of the cable from the rod, as during transport and/or cleaning of the equipment.

SUMMARY OF THE INVENTION

It is a major object of the invention to provide improved apparatus meeting the above needs. Basically, the improved apparatus is usable in conjunction with an upright support stand and an upright rod associated with the stand, the rod attached to the cymbal (or hi-hat) to move it vertically, in response to operation of a foot actuated pedal unit remote from the stand. The apparatus in this environment then comprises:

a) a frame associated with the stand, and a connector unit associated with the frame, the rod connected with that unit to be moved upwardly and downwardly by the unit, b) a flexible cable extending between the pedal unit and the connector unit, the cable having opposite ends, one end of the cable operatively connected with the pedal unit and the other end of the cable removably connected with the connector unit, to move the connector unit upwardly and downwardly in response to foot actuation of the pedal unit, c) and a sheath extending about the cable between the pedal unit and the frame, the cable movable endwise within the sheath, d) whereby the cable can be disconnected from the connector unit, and removed endwise from the sheath, for cleaning and lubrication thereof.

As will be seen, the frame may be attached to the stand, or a part thereof, for guiding the rod to be moved upwardly and downwardly.

It is another object to provide the frame with upper extent attached to the stand, and lower extent, the connector unit located between the frame upper and lower extents, and the cable extending through the frame lower extent for removable connection to the connector unit. The frame may advantageously have longitudinally elongated and laterally spaced frame parts extending between the frame upper and lower extents, the frame being generally rectangular and bounding the connector unit.

Yet another object is to provide the connector unit with spaced jaws between which the other end of the cable extends, and fastener means extending between the jaws and being tightenable to releasably clamp the jaws onto the other end of the cable. The frame may advantageously include a cover spaced from the fastener means and removable to provide access to the fastener means allowing release of the other end of the cable from the jaws.

A further object is to provide means carried by the stand and operatively connected with the rod, for yieldably urging the rod generally vertically. Such means may include a return spring located above the other end of the cable removably connected to the connector unit.

An additional object is to provide attachment means removably attaching the lower end of the rod to the connector unit; and such attachment means may be spaced from the cover to also be accessible when the cover is removed.

These and other objects and advantages of the invention, as well as the details of an illustrative embodiment, will be more fully understood from the following specification and drawings, in which:

DRAWING DESCRIPTION

DETAILED DESCRIPTION

Figure 1:
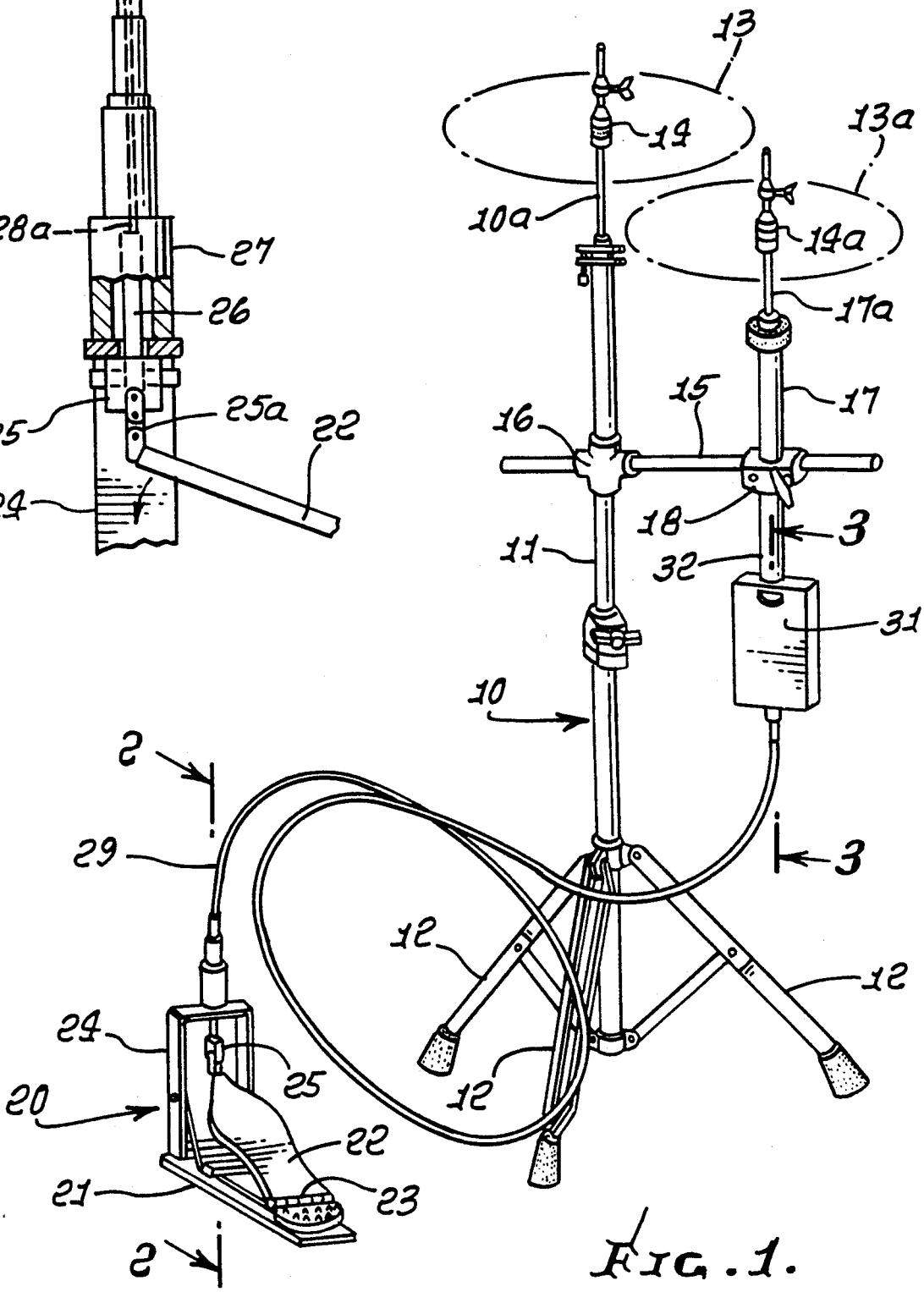
FIG. 1 is a perspective view of apparatus incorporating the invention.
Figure 3:
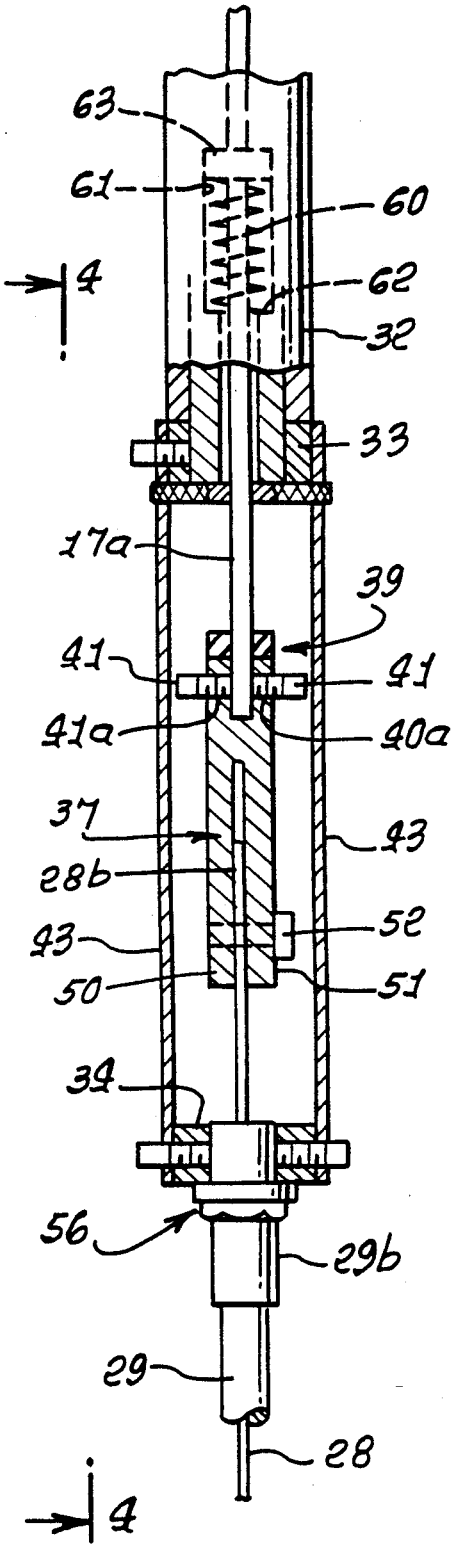
FIG. 3 is an enlarged section taken on lines 3—3 of FIG. 1.
Figure 5:
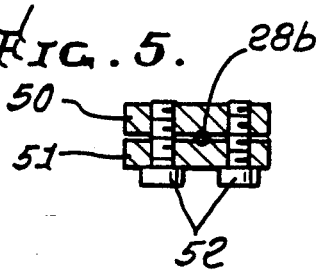
FIG. 5 is a horizontal section taken on lines 5—5 of FIG. 4.
Figure 4:
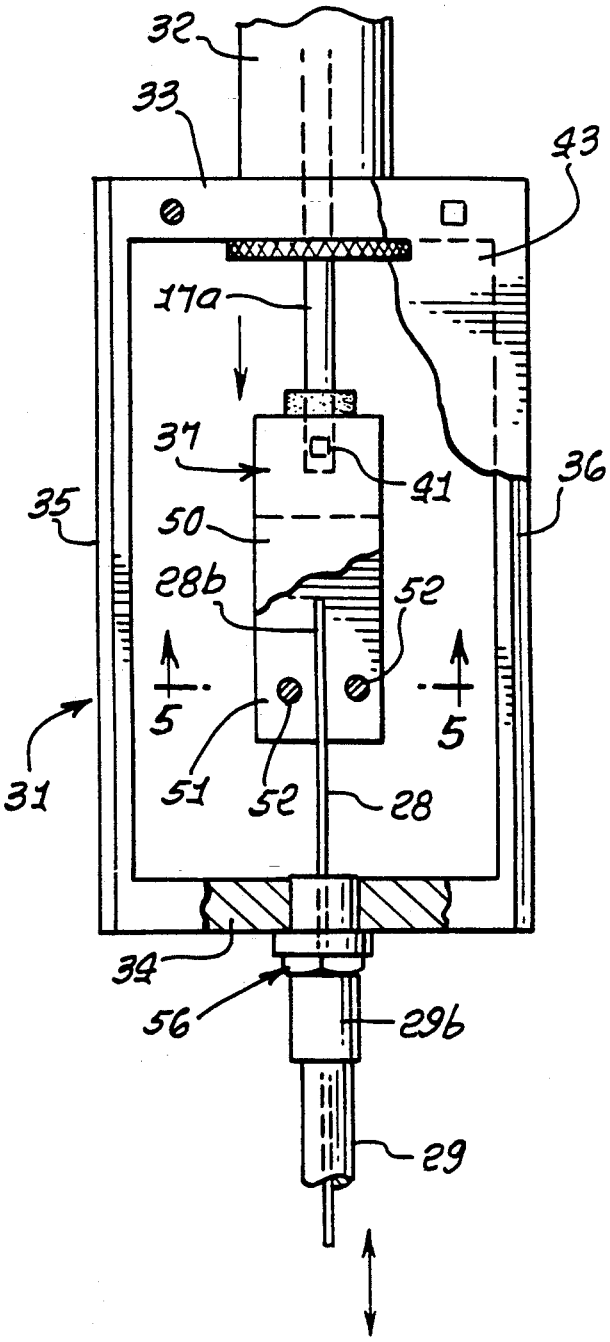
FIG. 4 is a side elevation taken on lines 4—4 of FIG. 3.

In FIG. 1, a cymbal or hi-hat stand 10 includes an upright post 11, supported by three legs 12, collapsible inwardly from their expanded positions, as shown, for transportation. A cymbal (or hi-hat) is shown schematically at 13, carried by structure 14 on the post upper structure 10*a*. A lateral bar 15 is carried by the post 11 at 16, and supports upright member 17, via a removable connection 18. Another cymbal (or hi-hat) is shown schematically at 13*a*, and is carried by structure 14*a* on the member 17 element 17*a*. Structures 14 and 14*a* may be connected to lower cymbals 13 and 13*a*, to be moved rapidly upwardly to strike upper cymbals. Typical structures 14 and 14*a* appear in U.S. Pat. No. 5,121,665.

Figure 2:
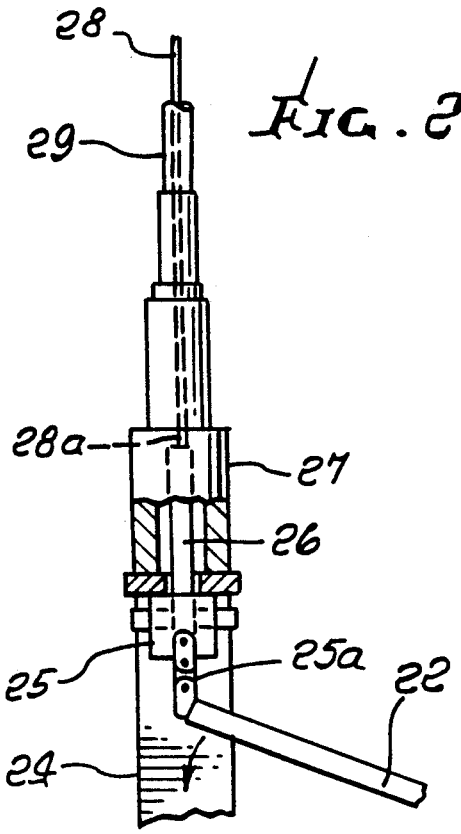
FIG. 2 is an enlarged section taken on lines 2—2 of FIG. 1.

Also shown in FIG. 1 is a drummer's foot actuated pedal unit 20 located remotely from the stand 10, and positionable as desired by the drummer. Unit 20 includes a bottom plate 21, a pedal 22, pedal hinge 23 connected to the plate, an upright frame 24, and an attachment 25 on the pedal to be moved up and down as the pedal is foot deflected. Attachment 25 is better seen in FIG. 2 to include a chain connected at its lower end 25*a* to the pedal, and connected at its upper end to a slider 26 movable up and down in a tubular housing 27.

A flexible cable 28 has its lower end 28*a* attached to the slider 26, and projects within a protective tubular sheath 29, the lower end 29*a* of which is attached to the housing 27. The housing 27 attaches to the transverse part 24*a* of frame 24. Accordingly, as the pedal 22 is moved up and down, the cable 28 moves endwise oppositely in and relative to the sheath. Viscous lubricant is applied to the space between the cable and its sheath to reduce sliding friction therebetween; however, such lubrication can become undesirably lessened due to build up of wear particles, dirt, etc., and congealed lubricant, in the clearance spaces between the cable and sheath. No way was previously known to easily alleviate this undesirable condition.

Referring to FIGS. 1 and 3-5, a guide frame 31 is associated with the stand 10, and may advantageously be attached to bar 15, as by a suspending upright tube 32 connected to 18. The frame includes an upper crosspiece 33, and lower crosspiece 34, and two longitudinally elongated, laterally spaced upright members 35 and 36, whereby the frame is generally rectangular.

A connector unit 37 is associated with the frame, and may be located within the space 38 bounded by 33, 34, 35, and 36, in such manner as to allow up and down movement of the connector unit 37. Cymbal rod 17*a* extends downwardly through 33 and has removable connection to 37, at 39. The latter includes two fasteners 40 and 41 with thread connection at 40*a* and 41*a* to unit 37, the inner ends of the fasteners engaging the rod 17*a* to removably attach it to the unit 37. The frame includes a side cover 43, which can be removed to provide access to 40 and 41, whereby the rod 14*a* may be easily detached from 37.

The upper end 28*b* of cable 28 is removably connected to the unit 37, to move the latter up and down in response to foot actuation of the pedal unit 20, as referred to above. As shown, the unit 37 has downwardly projecting jaws 50 and 51 between which the cable end 28*b* is upwardly insertible to be clamped by the jaws as set screws or fasteners 52 are tightened at opposite sides of the cable (see FIG. 4). Again, removal of the frame cover 43 allows access to fasteners 52. The upper end 29*b* of sheath 29 is removably attached at 56 to the frame lower crosspiece 34, whereby the cable is guided upwardly toward unit 37, positioned in the frame by rod 14*a*.

Accordingly, access to the cable is easily achieved, and its disconnection from 37 is easily accomplished, whereby the cable may be withdrawn from the sheath to allow cleaning of dirt, particles, etc., from the sheath interior, and from the cable exterior. Fresh lubricant can then be applied to the sheath interior, and to the cable, and the cable reinserted into the sheath and reattached to the unit 37.

Means is carried by the stand and operatively connected with rod 17*a*, for yieldably urging the rod generally vertically. Such means is shown in the form of a return spring 60 located above the upper end 28*a* of the cable and above unit 37. Spring 60 is shown as located in a bore 61 in tube 32 and seats at 62. The spring upper end urges a flange 63 on rod 17*a* upwardly, whereby, after cable 28 is displaced downwardly by the pedal unit 20 and released, the spring 60 will return 37 and rod 17*a* upwardly.

I claim:

1. For use in actuating a cymbal or the like, there being an upright support stand and an upright rod associated with the stand and attached to the cymbal to move it vertically, and there being a foot activated pedal unit remote from the stand, the combination comprising a) a frame associated with the stand, and a connector unit associated with the frame, said rod connected with s id connector unit to be moved upwardly and downwardly by said unit, b) a flexible cable extending between said pedal unit and said connector unit, the cable having opposite ends, one end of the cable operatively connected with the pedal unit and the other end of the cable removably connected with said connector unit, to move the connector unit upwardly and downwardly in response to foot actuation of the pedal unit, c) and a sheath extending about the cable between said pedal unit and said frame, the cable movable endwise within the sheath, d) whereby the cable can be disconnected from the connector unit, and removed endwise from the sheath, for cleaning and lubrication thereof.

2. The combination of claim 1 including said stand and wherein said frame is attached to the stand for guiding the rod to be moved upwardly and downwardly.

3. The combination of claim 1 wherein said frame has upper extent attached to the stand, and lower extent, said connector unit is located between said frame upper and lower extents, and said cable extends through said frame lower extent for removable connection to said connector unit.

4. The combination of claim 3 wherein said frame has longitudinally elongated and laterally spaced frame parts extending between said frame upper and lower extents, the frame being generally rectangular and bounding said connector unit.

5. The combination of claim 1 wherein said connector unit has spaced jaws between which said other end of the cable extends, and fastener means extending between said jaws and tightenable to clamp said jaws onto said other end of the cable.

6. The combination of claim 4 wherein said connector unit has spaced jaws between which said other end of the cable extends, and fastener means extending between said jaws and tightenable to clamp said jaws onto said other end of the cable.

7. The combination of claim 5 wherein the frame includes a removable cover spaced from said fastener means and removable to provide access to said fastener means to allow release of said other end of the cable from said jaws.

8. The combination of claim 6 wherein the frame includes a removable cover spaced from said fastener means and removable to provide access to said fastener means to allow release of said other end of the cable from said jaws.

9. The combination of claim 3 wherein said sheath has connection to said frame lower extent, to pass the cable upwardly to said connector unit.

10. The combination of claim 2 including urging means carried by the stand and operatively connected with said rod, for yieldably urging the rod generally vertically.

11. The combination of claim 10 wherein said urged means comprises a return spring located above said other end of the cable removably connected to said connector unit.

12. The combination of claim 1 including attachment means removably attaching the lower end of said rod to said connector unit.

13. The combination of claim 7 including attachment means removably attaching the lower end of said rod to said connector unit, and said attachment means spaced from said cover to also be accessible when the cover is removed.

* * * * *